United States Patent [19]
Miyashita et al.
[11] 4,213,524
[45] Jul. 22, 1980

[54] AUTOMATIC VENDING MACHINE WITH LOTTERY BONUS

[75] Inventors: Toshio Miyashita, Tokyo; Yoshizo Fujii, Nishinomiya; Takeshi Sawabe, Urawa, all of Japan

[73] Assignee: Shinko Automatic Device Co., Ltd., Yashio, Japan

[21] Appl. No.: 926,603

[22] Filed: Jul. 21, 1978

[30] Foreign Application Priority Data

| | | | |
|---|---|---|---|
| Jul. 23, 1977 | [JP] | Japan | 52-98653 |
| Nov. 24, 1977 | [JP] | Japan | 52-157690 |
| Dec. 16, 1977 | [JP] | Japan | 52-170258 |
| Jun. 6, 1978 | [JP] | Japan | 53-67244 |

[51] Int. Cl.[2] ..... G07F 11/00
[52] U.S. Cl. ..... 194/2; 194/10; 194/15; 235/92 GA; 273/138 A
[58] Field of Search ..... 194/2, 9, 10, 15.1 R, 194/DIG. 11; 273/138 R, 138 A, 1 T, 118 A, 119 A, 121 A, 122 A, 123 A, 124 A, 125 A, 1 G, 1 H; 235/92 GA, 92 CN

[56] References Cited

U.S. PATENT DOCUMENTS

| | | | |
|---|---|---|---|
| 3,185,279 | 5/1965 | Spears | 194/9 T |
| 3,263,788 | 8/1966 | Jensen et al. | 194/15 X |
| 3,269,503 | 8/1966 | Foster | 235/92 GA |
| 3,292,759 | 12/1966 | Meixner et al. | 194/15 |
| 3,609,311 | 9/1971 | Wayne | 273/138 A UX |
| 3,653,026 | 3/1972 | Hurley | 273/138 A X |
| 3,852,576 | 12/1974 | Rudd | 235/92 GA |
| 4,013,157 | 3/1977 | Britz et al. | 194/15 X |
| 4,060,242 | 11/1977 | Huang et al. | 273/138 A X |

*Primary Examiner*—Robert J. Spar
*Assistant Examiner*—Edward M. Wacyra
*Attorney, Agent, or Firm*—Lawrence I. Field

[57] ABSTRACT

An automatic vending machine comprises a plurality of electric lamps arranged geometrically on a front panel of a housing and a lamp control circuit for lighting the lamps successively and repeatedly in response to a signal which is generated in accordance with a vending operation of the machine. The lamps are arranged equidistantly along a circle and thus a light spot appears to rotate along the circle. In a preferred embodiment the lamp control circuit comprises a lottery circuit which produces a winning signal for discharging an extra article as a free addition and at the same time the light spot is stopped at a predetermined lamp having a lucky number applied thereto.

15 Claims, 11 Drawing Figures

FIG. 10

(a)

| Address Position | 0 | 1 | 2 | 3 | 4 | 5 | 6 | 7 | 8 | 9 |
|---|---|---|---|---|---|---|---|---|---|---|
| | 1 | 1 | 1 | 1 | 1 | 1 | 1 | 1 | 1 | 1 |

(b)

| Address Position | 0 | 1 | 2 | 3 | 4 | 5 | 6 | 7 | 8 | 9 |
|---|---|---|---|---|---|---|---|---|---|---|
| 1st Column | 1 | 1 | 1 | 1 | 1 | 1 | 1 | 1 | 1 | 1 |
| 2nd Column | 1 | 1 | 1 | 1 | 1 | 1 | 1 | 1 | 1 | 1 |
| 3rd Column | 1 | 1 | 1 | 1 | 0 | 0 | 0 | 1 | 0 | 0 |

(c)

| Address Position | 0 | 1 | 2 | 3 | 4 | 5 | 6 | 7 | 8 | 9 |
|---|---|---|---|---|---|---|---|---|---|---|
| 1st Column | 1 | 1 | 1 | 1 | 1 | 1 | 1 | 1 | 1 | 1 |
| 2nd Column | 3 | 3 | 3 | 3 | 2 | 2 | 2 | 3 | 2 | 2 |

AUTOMATIC VENDING MACHINE WITH LOTTERY BONUS

BACKGROUND OF THE INVENTION

The invention relates to an automatic vending machine comprising a housing with a front panel in which a section for displaying one or more articles available for users, a section for receiving coins and/or bills, and a section for discharging one or more articles stocked in the housing.

Nowadays there have been used various kinds of automatic vending machines for vending various kinds of goods or articles. In many cases a single automatic vending machine can vend a few kinds of similar articles. In such a machine there is further provided on the front panel a section for selecting any one of these articles. For example, there are arranged on the front panel a plurality of article selection push buttons and when any one of them is actuated by a user after a given amount of money has been inserted, the machine can discharge one or more articles which have been selected by the user. Usually the automatic vending machine further comprises a section for counting an amount of coins and/or bills inserted, a section for displaying the counted value of the inserted money, a section for admitting a discharge of articles, a section for calculating change, a section for discharging the calculated change, a section for checking the discharging operation of the articles, a section for indicating or displaying a "hindrance" of the machine, and a section for indicating a "sold out" of articles.

The above mentioned various sections are necessary for completing the correct vending operation in the automatic vending machine. Thus the freedom of design is very little and all of the known machines have substantially the same outer appearance. In order to make a noticeable difference the automatic vending machine should have particular ornamentation and/or particular function so as to increase purchasing power of users.

SUMMARY OF THE INVENTION

The present invention has for its object to provide an automatic vending machine which has a particular ornamental apperance so as to make it differs from the known vending machines.

It is another object of the invention to provide an automatic vending machine which has a novel function which can discharge extra articles as free additions in a lottery.

It is still another object of the invention to provide an automatic vending machine with the lottery function in which a winning probability can be adjusted at will with respect to the number of vending operations.

According to the invention an automatic vending machine comprises a housing which includes a front panel, means provided in the front panel for receiving coins and/or bills, a stocker means provided in the housing for storing articles available for users, means for discharging one or more articles stored in the stocker means through an outlet provided in the front panel, a plurality of lamps arranged geometrically on the front panel and a lamp control circuit for lighting said lamps successively and repeatedly in response to a signal generated by an operation of the vending machine.

In a preferred embodiment of the invention said plurality of lamps are arranged equidistantly on a circle and are successively energized at such a period that a light spot appears to rotate along the circle.

In another embodiment of the automatic vending machine according to the invention the lamp control circuit comprises a lottery circuit which gives extra articles as free additions and stops the light spot at a predetermined lamp having a lucky number applied thereto.

BRIEF DESCRIPTION OF THE DRAWINGS

FIGS. 10*a* to 10*c* are schematic diagrams showing three embodiments of an arrangement of an address position in a read only memory provided in the lottery circuit illustrated in FIG. 9.

DESCRIPTION OF THE PREFERRED EMBODIMENTS

Figure 1:
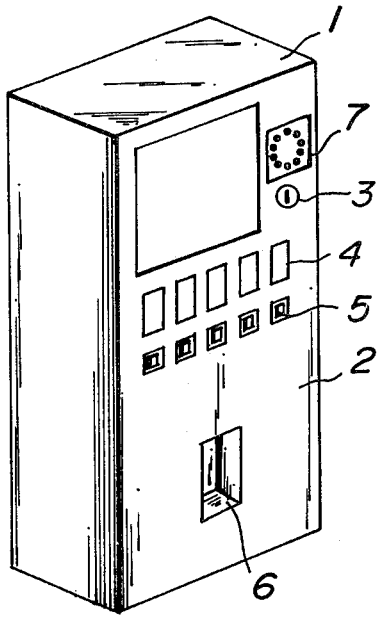
FIG. 1 is a perspective view showing an automatic vending machine according to the invention.
Figure 2:
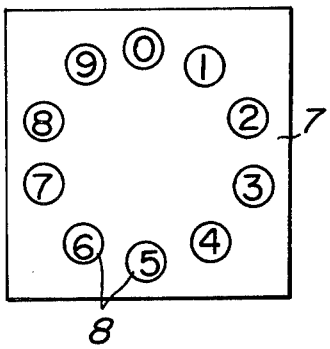
FIG. 2 is a plan view illustrating a roulette plate provided on a front panel of the automatic vending machine shown in FIG. 1.

FIG. 1 is a perspective view showing the outer appearance of an embodiment of the automatic vending machine according to the invention. The machine comprises a housing 1 having a front panel 2 in which are provided a coin receiving section in a form of a slot, a section 4 for displaying brands or kinds of articles available for users, a plurality of selection buttons 5 and an article discharging section 6 in a form of an outlet opening. In this embodiment the front panel 1 is further provided with an electric lamp roulette plate 7. As shown in FIG. 2 the roulette plate 7 comprises a plurality of lamps, in this embodiment ten lamps 8 arranged equidistantly along a circle. In front of each lamp 8 is provided a transparent or translucent cover on which is applied a digit 0, 1 - - - or 9. It should be noted that according to the invention it is not always necessary to put a numerical figure on the cover. In some cases the cover may be colored.

Figure 3:
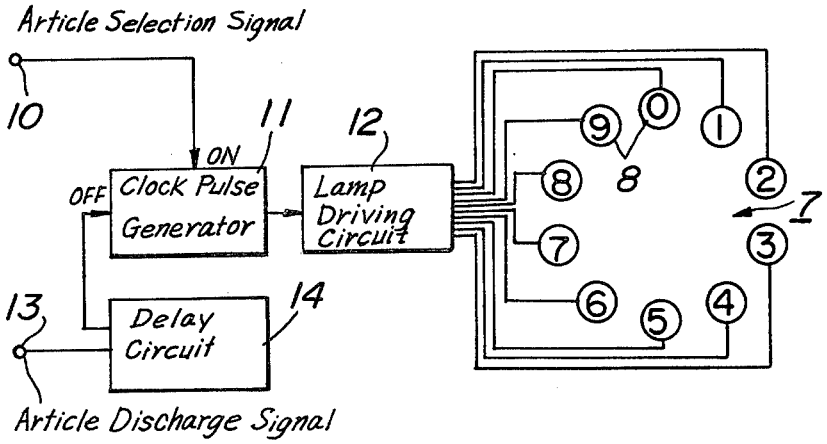
FIG. 3 is a block diagram of an embodiment of a lamp control circuit according to the invention.

FIG. 3 is a schematic book diagram showing an embodiment of a lamp control circuit for lighting on and off repetitively the lamps 8 of the electric lamp roulette plate 7. When a given amount of coins is inserted into the slot 3 in the front panel 2 and a selection button 5 corresponding to a desired article is depressed, an article selection signal is generated. This signal is supplied to an input terminal 10 to actuate a clock pulse generator 11. Clock pulses from the generator 11 are supplied to a lamp driving circuit 12 having a ring counter and the lamps 8 are successively energized at a given repetition period. This repetition period is so selected that a light spot is seen to rotate along the circle of the lamps 8 just like a rotating roulette ball.

The article selection signal is also supplied to an article discharging mechanism which discharges one or more selected articles through the outlet opening 6. This article discharge operation is detected to produce an article discharge signal which is supplied to a time delay circuit 14 through an input terminal 13. The delay circuit supplies a stop signal to the clock pulse generator 11 after a given time period of, for example 2 to 3 seconds. When the generator 11 ceases to produce the clock pulses, the lamp driving circuit 12 is deenergized and all lamps 8 are off, so that the light spot disappears.

Figure 4:
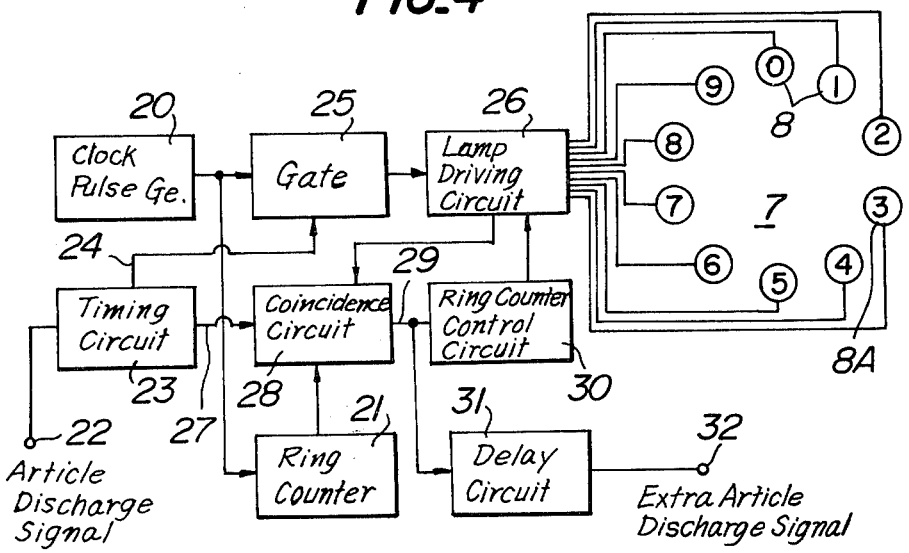
FIG. 4 is a block diagram of an embodiment of a roulette lamp control circuit according to the invention.

FIG. 4 is a block diagram illustrating another embodiment of the lamp control circuit according to the invention. In this embodiment the automatic vending machine is provided with a lottery function. A lighting condition of the roulette lamps 8 is used to indicate a winning in the lottery. For instance, if a lucky number is determined to be "3", the lamp having the digit "3" applied thereon remains lighted after the light spot is rotated over several times and at the same time an extra article is discharged as a free addition.

In the present embodiment a clock pulse generator 20 is always energized and a ring counter 21 counts clock pulses from the generator 20. To an input terminal 22 is supplied an article discharge signal which is further fed to a timing circuit 23. The timing circuit makes a gate circuit 25 conductive via a line 24 for a given time period such as two seconds. During this time period the clock pulses are supplied to a lamp driving circuit 26. The lamp driving circuit 26 comprises a ring counter for counting the clock pulses. During the time interval in which the gate 25 is made conductive the timing circuit 23 supplies a trigger pulse through a line 27 to a coincidence circuit 28 which compares the count value of the ring counter 21 at that instant with the count value of the ring counter in the lamp driving circuit 26. When these count values are coincident with each other, the machine detects this as the winning in the lottery. Then the coincidence circuit 28 supplies a winning signal on a line 29. Upon receiving the winning signal a ring counter control circuit 30 controls the lamp driving circuit 26 in such a manner that the light spot will stop at the predetermined lamp 8A having the lucky number "3" of the roulette plate 7. The winning signal on the line 29 is also fed to a delay circuit 31 which supplies an extra article discharge signal to a terminal 32 while the lamp having the digit "3" applied thereto is lighted. The signal at the terminal 32 is supplied to the article discharging mechanism to discharge an extra article as a free addition from the outlet opening 6. This extra article may be the same as that selected by the user or any other article. Upon discharging the extra article the article discharge signal should not be supplied to the terminal 22. The lottery mechanism may be reset by means of a next coming coin insertion signal or article selection signal.

On the other hand when the coincidence is not detected by the circuit 28, i.e. the user fails to win the lottery, the lamp driving circuit 26 continues to count the clock pulses while the gate circuit 25 is made conductive and the light spot is stopped at any lamp having a digit other than the lucky number "3". In this embodiment a winning in the lottery is determined accidentally, but the probability of winning can be determined by changing the maximum count value of the ring counter 21.

Figure 5:
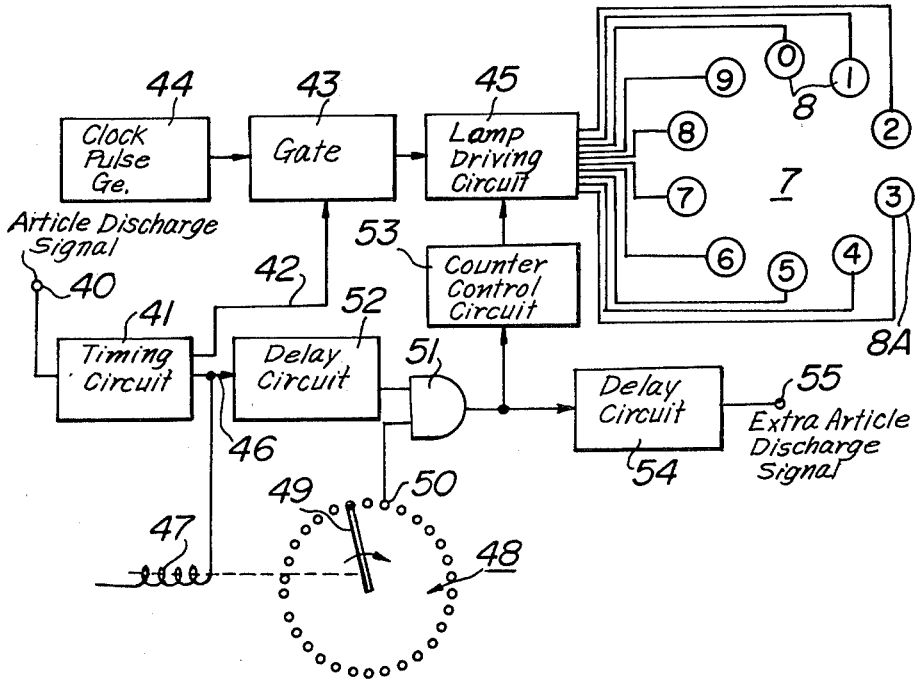
FIG. 5 to FIG. 7 are block diagrams of other embodiments of the roulette lamp control circuit according to the invention.

FIG. 5 is a block diagram showing another embodiment of the lamp control circuit of the automatic vending machine having the lottery function. In the embodiment shown in FIG. 4 the machine has the true lottery function and the winning in the lottery is completely dependent on chance. But such a machine is not suitable for practical use. In the present embodiment winning in the lottery is determined with respect to the given number of article vending operations. An article discharge signal is supplied to a timing circuit 41 through an input terminal 40. The timing circuit 41 produces a signal on a line 42 which signal is fed to a gate circuit 43. Then the gate is made conductive for two or three seconds. While the gate circuit 43 is made conductive clock pulses from a clock pulse generator 44 are supplied to a ring counter provided in a lamp driving circuit 45 and the lamps 8 on the roulette plate 7 are successively lighted at a given repetition period so that a light spot appears to rotate. The timing circuit 41 produces a signal on a line 46 at a suitable instant while the gate circuit 43 is made conductive to energize an electric magnet 47 which advances a rotating arm 49 of a rotary switch 48 by one step. The rotary switch 48 has a number of fixed contacts, for example thirty contacts and at least one of the contacts, in this case a contact 50 is connected to one input of an AND gate 51. When the rotating arm 49 is in contact with the contact 50, a logic signal "1" is supplied to the one input of AND gate 51. To the other input of the AND gate 51 is applied the signal on the line 46 through a delay circuit 52 as a logic signal "1". In this manner a winning signal is supplied from the AND gate 51 every time thirty article discharge signals are supplied to the input terminal 40. The winning signal is fed to a counter control circuit 53 which then controls the ring counter 45 in such a manner that the light spot is stopped at the lamp having the digit "3" appended thereto. The winning signal from the AND gate 51 is also supplied to a terminal 55 through a delay circuit 54 as an extra article discharge signal. According to the present embodiment the winning is determined by the rotary switch 48 which is actuated in a stepwise manner in response to the article vending operation and thus the winning does not occur by chance, so that the management of the vending machines is rather easy. That is to say a rate of discharging the extra articles with respect to the number of article vending operations can be certainly predetermined such as one extra article for thirty articles. This rate may be changed by changing the number of winning contacts and/or losing contacts.

Figure 6:
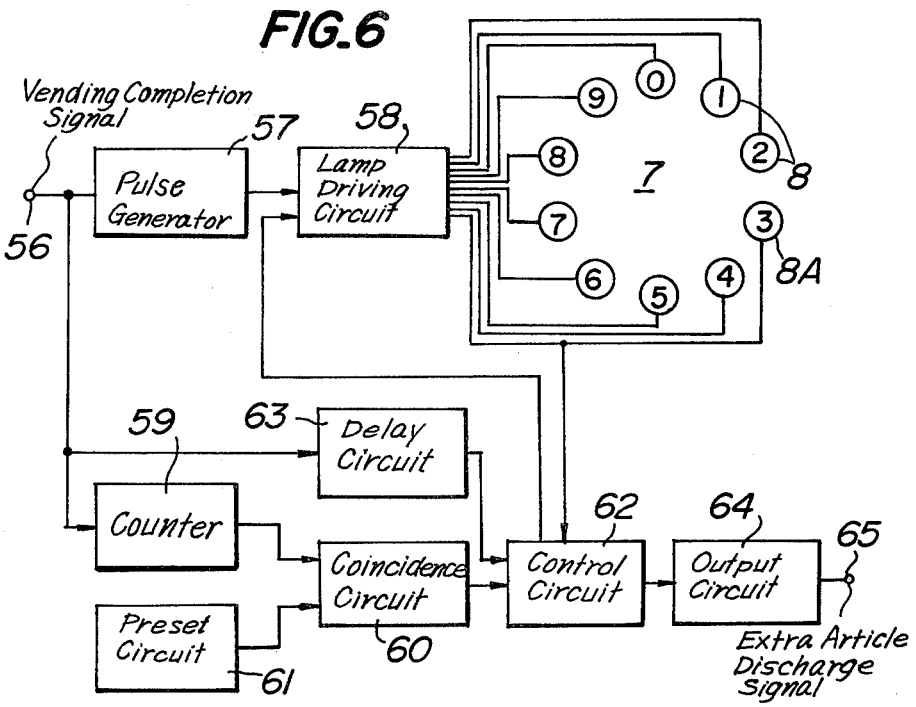

FIG. 6 is a block diagram showing another embodiment of the lamp control circuit provided in the automatic vending machine according to the invention which has a lottery function. To an input terminal 56 is supplied a vending completion signal which is fed to a pulse generator 57 to start the generation of pulses. The pulse generator 57 comprises a capacitance and a voltage-frequency converter to which is applied a varying voltage across the capacitance so as to produce pulses having a repetition period which increases in accordance with time. These pulses are supplied to a lamp driving circuit 58 including a ring counter. Thus the light spot on the roulette plate 7 is seen to rotate along the lamp circle with a decreasing speed.

The vending completion signal is further fed to a counter 59 and a count value is supplied to a coincidence circuit 60 to which is supplied a preset count value from a preset circuit 61 in which a probability of winning in the lottery can be set. When the coincidence is detected in the circuit 61, a signal is supplied to a control circuit 62 to which is also fed the vending completion signal through a delay circuit 13 having a delay time of a few seconds. When the control circuit 62 receives the signal from the delay circuit 63 to which control circuit 62 the coincidence signal is supplied from the circuit 60, the control circuit 62 produces a signal to the lamp driving circuit 58 so as to stop the light spot at the predetermined lamp 8 having the winning digit of, for example "3". At the same time the control circuit 62 sends a signal to an output circuit 64 which produces an extra article discharge signal to an output terminal 65.

On the other hand when the coincidence is not detected, the control circuit 62 controls the lamp driving circuit 58 in such a manner that the rotating light spot on the roulette plate 7 stops at any lamp having a digit other than the lucky number "3".

According to the present embodiment the winning probability of the lottery can be predetermined by adjusting the count value in the preset circuit 61.

In the embodiments shown in FIGS. 5 and 6 the winning in the lottery occurs in a regular manner, i.e. winning is given every time the predetermined number of vending operations has been effected. In order to increase the function of lottery it is desirable to give the windings at random. Even in this case the winning probability should be set to a predetermined value in order to effect an easy management of the vending machines. An embodiment of such a vending machines will be explained hereinafter.

Figure 7:
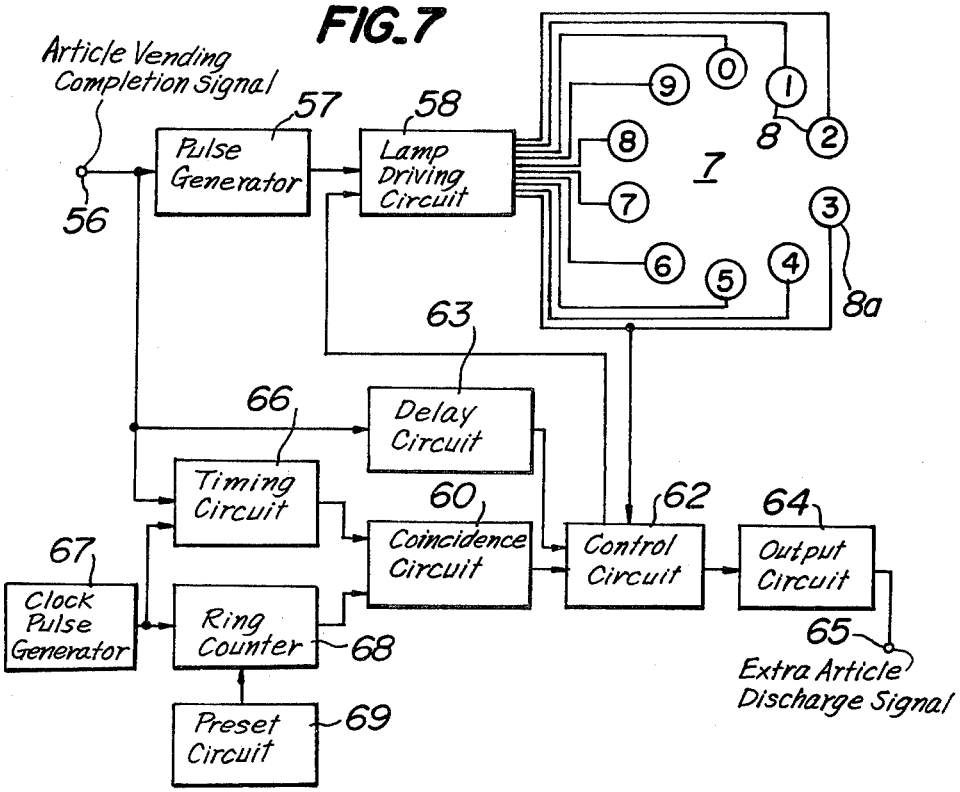
Figure 8:
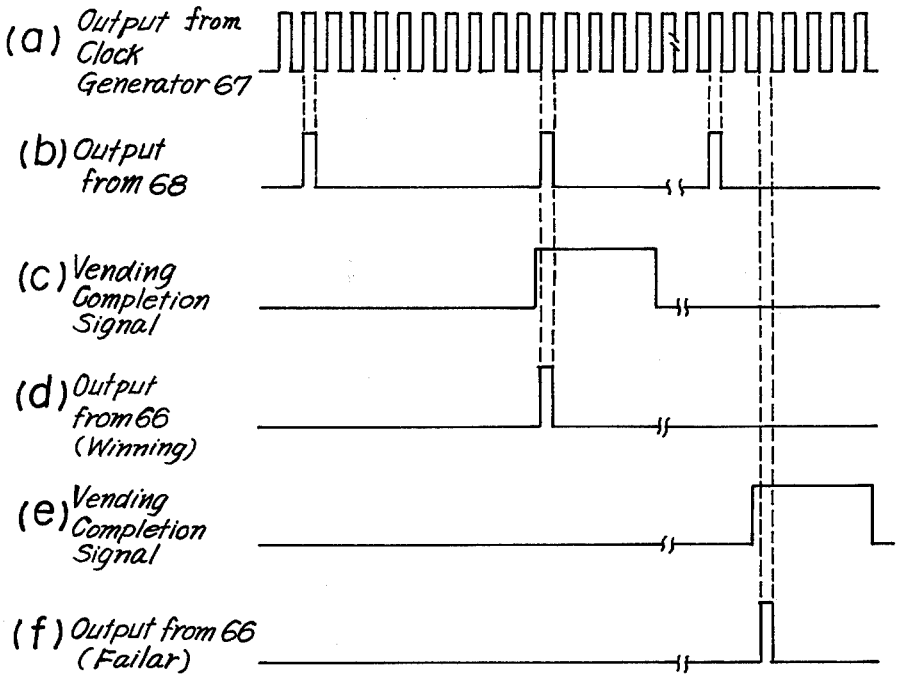
FIGS. 8*a* to 8*f* show waveforms for explaining the operation of the circuit of FIG. 7.

FIG. 7 is a block diagram showing an embodiment of the lamp control circuit of the automatic vending machine according to the invention. In this embodiment parts which are same as those of the embodiment shown in FIG. 6 are denoted by the same reference numerals. The article vending completion signal is supplied to a timing circuit 66 to which are also fed clock pulses (see FIG. 8*a*) generated from a clock pulse generator 67 which is made always operative. When the article vending completion signal (see FIGS. 8*c* and 8*e*) is supplied to the timing circuit 66, it produces an output pulse (see FIGS. 8*d* and 8*f*) which is synchronized with the clock pulse. The clock pulses are also fed to a ring counter 68 the maximum count value of which can be set by means of a preset circuit 69. The counter produces an output as shown in FIG. 8*b* every time it reaches the predetermined maximum count value, e.g. a ten count, which is synchronized with the clock pulse. The output pulses from the timing circuit 66 and counter 68 are supplied to a coincidence circuit 60. As shown in FIGS. 8*b* and 8*d* when these output pulses coincide with each other, the coincidence circuit 60 supplies a signal to a control circuit 62 to which is also fed the article vending completion signal through a delay circuit 63. As explained with reference to FIG. 6 then the light spot stops at the predetermined lamp 8A having the lucky number "3" on the roulette plate 7 and an extra article is discharged as a free addition.

When a coincidence is not detected by the coincidence circuit 60 as shown in FIGS. 8*b* and 8*f*, the lamp driving circuit 58 is so controlled that the light spot stops at any lamp other than the lamp 8A and no extra article is discharged.

According to the present embodiment since the article vending completion signals are supplied at random the winnings in the lottery are given at random, but the winning probability over a number of vending operations can be preset by adjusting the maximum count value of the ring counter by means of the preset circuit 69.

In some applications it has been found inconvenient that the winning probability is determined only for a large number of article vending operations.

Figure 9:
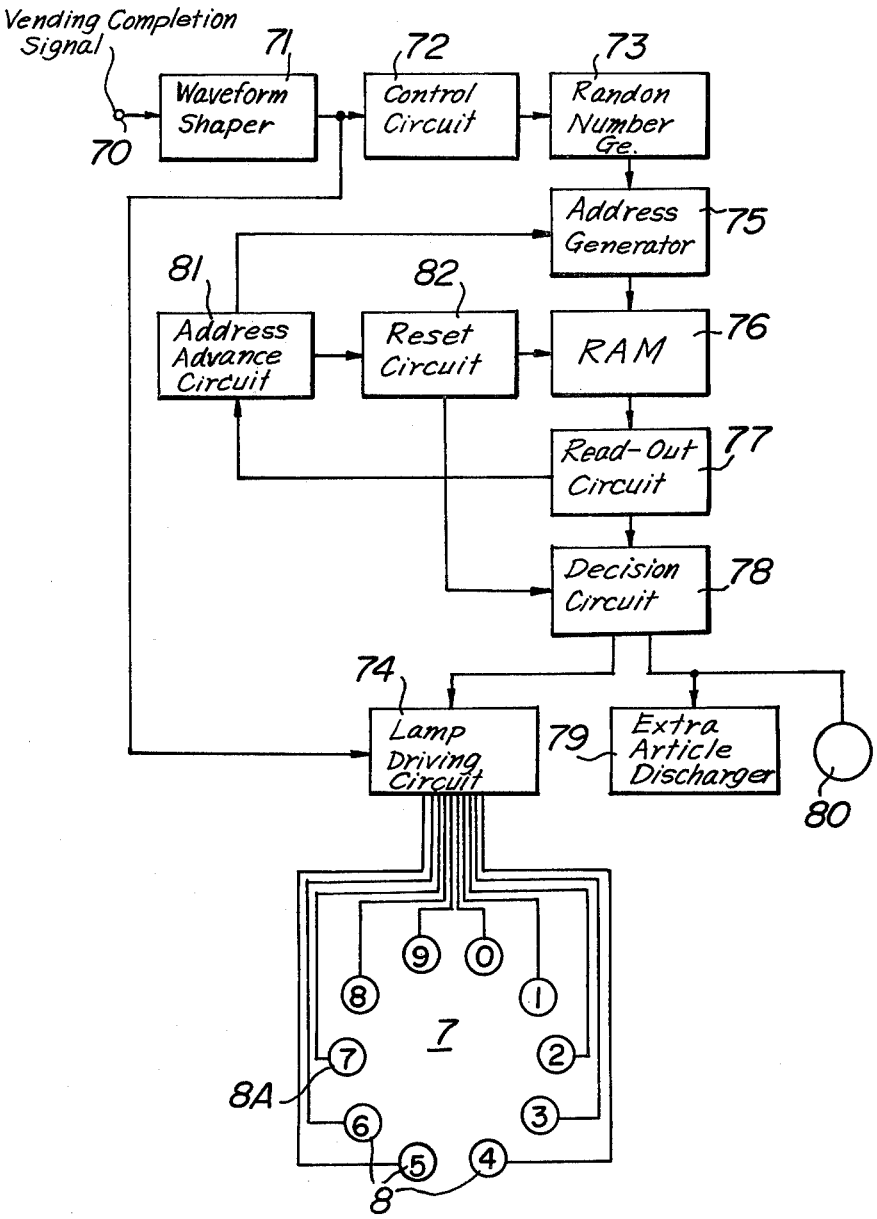
FIG. 9 is a block diagram illustrating still another embodiment of the roulette lamp control circuit according to the invention.

FIG. 9 is a block diagram illustrating another embodiment of the lamp control curcuit of the automatic vending machine according to the invention in which the winning probability may be determined for a small number of vending operations. To an input terminal 70 is supplied an article vending completion signal which is further fed through a wave form shaping circuit 71 to a circuit 72 for controlling a random number generated 73 which in turn generates figures or numbers 0 to 9 at random. The random number generator 73 may be formed by a high speed ring counter which counts clock pulses of a high repetition frequency. Since the counter is stopped at an arbitrary instant the count value at such a instant is entirely arbitrary. The output signal from the circuit 71 is also fed to a lamp driving circuit 74 to light the successive lamps 8 repeatedly. The control circuit 72 actuates the random number generator 73 for a given time period and then stops the generator 73. In this case the generator 73 produces any one of ten digits 0 to 9 and this digit is supplied to an address generator 75 which produce an address signal corresponding to the supplied digit. This address signal is supplied to a random access memory 76 (hereinafter referred as RAM) and an address position corresponding to the address signal is read out. Now it is assumed that an address position corresponding to the number "7" is set as a winning position. When the random number generator 73 is stopped and the winning number "7" is generated, the winning position in the RAM 76 is read out by a read out circuit 77. A read out signal is identified as a winning in a lottery at a decision circuit 78. Then the decision circuit 78 sends a signal to a lamp driving circuit 74 which controls the lamps 8 on the roulette plate 7 in such a manner that the rotating light spot is seemed to stop at a lamp 8A having the winning number applied thereto. The winning signal is also supplied to a device 79 for discharging an extra article and to a buzzer 80 which is actuated for a few seconds.

In order to keep the predetermined winning probability it is necessary to memorize any address positions which have been read out. For example when the winning probability is set to such a value that a winning is given for nine failures, the address positions are arranged as shown in FIG. 10*a*. The address position stores initially "1" and when it is read out, its state changes into "0". If the winning probability is so set that three winnings are given for twenty two failures, the address position can be arranged as shown in FIG. 10*b*. When an address position is read out first time, an address position of a first column at the related address number is first changed into "0". Then the stored contents in the positions of second and third columns of the related address number are successively shifted upwards. Thus in the address position of the third column of the related address number there is written "0".

FIG. 10*c* illustrates another embodiment of the construction of the address position. In address positions in a second column there are stored the numbers of failures and winning. When an address position in a first column of a certain address number is read out, the content in the address position of the second column of the related address number is decreased by "1". When a result of this subtraction is positive, "1" is stored in the address position of the second column of the related address number. If a result of the subtraction is zero, "0" is written into the related address position of the first column.

When the RAM76 is set as shown in FIG. 10*a* and the address number "7" has been already read out once, the contents of the address position of the related address number is "0". Therefore when the address number "7" is again supplied, the read out circuit 17 detects that this position has been read out and sends a signal to an address advance circuit 81. The address advance circuit 81 advances the address number by one to generate an address number "8" which is supplied to the address generator 75. The advance of the address number is effected in the order of 0, 1, 2 - - - 9, 0, 1 - - - . By means of the newly generated address number "8", the address position "8" is read out. Since the address position "8" is determined to be failure no extra article discharging signal is produced. If this address position has been also read out, the address signal is again supplied to the address advance circuit 81 and a new address number "9" is produced. Then the address position "9" is read out. In this manner the address positions are automatically scanned in succession and an address position which has not been read out is sought.

In case of the arrangements illustrated in FIGS. 10*b* and 10*c* the similar operations are effected, but in these cases the address positions of the first column are only read out.

When all address positions of the RAM76 have been read out, after all address positions have been once scanned by means of the loop comprising the address generator 75, RAM76, read out circuit 77 and address advance circuit 81 the address advance circuit 81 supplies a reset signal through a random access memory reset circuit 82 to the RAM76. Then the RAM76 is reset to the initial condition. Therefore the winning probability of the present embodiment becomes 1/10 in case of FIG. 10*a* and 3/25 in case of FIGS. 10*b* and 10*c*.

The numbers of the winning and failure address positions can be set by a setting device installed in the automatic vending machine. In the initial state these set numbers are read out and are stored into the RAM76 in a programatic manner.

Figure 11:
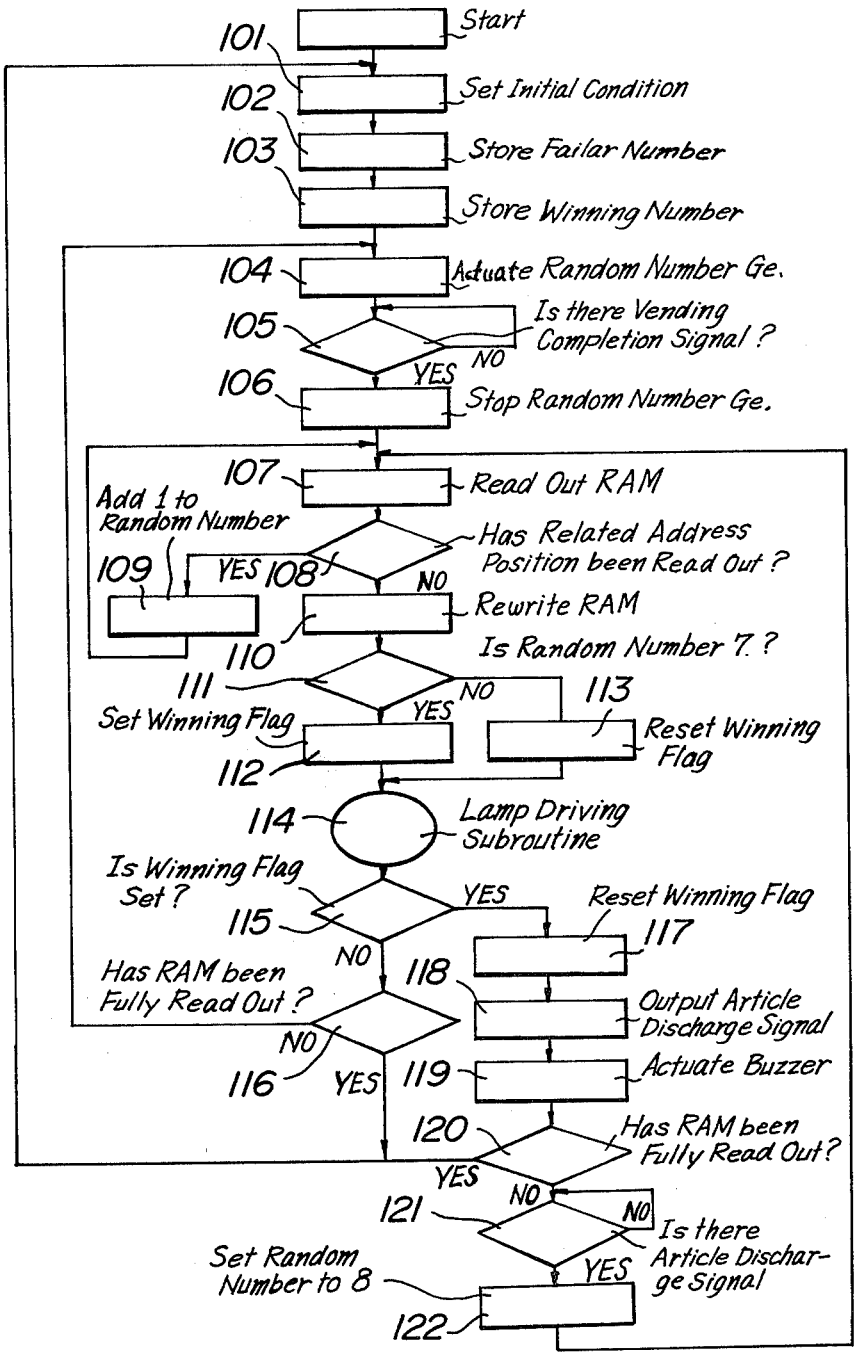
FIG. 11 is a flow chart for explaining the operations of the roulette lamp control circuit comprising a microcomputer.

According to the invention the arrangement shown in FIG. 9 may be constructed by a microcomputer. FIG. 11 shows an example of a flow chart in case of using the microcomputer. The flow chart is similar to the operations of the embodiment of FIG. 9 and thus a brief explanation is sufficient.

(101) Clear the contents of RAM.
(102) Read out the number of failures and store it in RAM.
(103) Read out the number of winnings and write it in RAM.
(104) Actuate the random number generator.
(105) Is there the vending completion signal?
(106) When the vending completion signal is provided, stop the random number generator to produce a random number.
(107) Read out an address position corresponding to the produced random number.
(108) Has the related address position been read out?
(109) When the related address position has been already read out in (108), advance the address number produced in (106) by one.
(110) Change the content of the related address position.
(111) Is the related address number the winning number "7"?
(112) When the related address number is the winning number "7", set a winning flag.
(113) When the related address number is not the winning number "7", reset the winning flag.
(114) Light the lamps on the roulette plate in succession and the rotation speed of the light spot is decreased gradually. At last stop the light spot at the lamp having the related number applied thereto.
(115) Does the winning flag set?
(116) Whether or not the contents of all address positions in RAM have been read out? If yes, return to the item (101) and initiate from the start.
(117) Reset the winning flag.
(118) When the winning flag is set in (115), produce the output signal for allowing the discharge of an extra article.
(119) When the winning is given, actuate the buzzer.
(120) Whether or not RAM has been all read out? If yes, return to the item (101).
(121) Whether or not the extra article discharge signal is produced?
(122) Change the random number to "8" in order not to give the winning by means of the extra article discharging operation.

The present invention is not limited to the embodiments explained above and many modifications may be conceived within the scope of the invention. For instance in the above embodiments a plurality of lamps are arranged along a circle, but they may be arranged along a spiral, a straight line, a curve, or a zig.zag track. In case of the winning all lamps may be simultaneously lighted on and off after the light spot has been stopped at the winning lamp. In the embodiment shown in FIG. 9 the address number is increased by one when the related address position has been already read out, but the address number may be increased by a different number such as two and three or may be decreased.

What is claimed is:

1. An automatic vending machine comprising:
a housing including a front panel;
means provided in the front panel for displaying at least one article available for users;
means provided in the front panel for receiving coins and/or bills;
stocker means provided in the housing for storing the articles available for users;
means for discharging at least one article stored in the stocker means in response to an article discharge signal through a discharge opening provided in the front panel;
a plurality of lamps arranged geometrically on the front panel and provided with covers having numbers applied thereto; and
a lamp control circuit for lighting on and off said lamps successively and repeatedly in response to a signal which is generated each time the vending operation is effected, a repetition period of the lighting on and off being such that a light spot appears to move along said geometrical lamp arrangement, wherein said lamp control circuit further comprises a lottery circuit for producing a winning signal in response to a signal generated by the vending operation of the machine to stop the light spot at a predetermined lamp having a lucky number applied thereto and the machine further comprises means to drive said article discharging means additionally to discharge at least one extra article as a free addition in response to the winning signal.

2. An automatic vending machine according to claim 1, wherein said lamps are arranged equidistantly on a circle.

3. An automatic vending machine according to claim 1, wherein said lamps are arranged substantially equidistantly along a spiral.

4. An automatic vending machine according to claim 1, wherein said lamps are arranged along a zig.zag track.

5. An automatic vending machine according to claim 1, wherein said lamps are arranged equidistantly along a straight line.

6. An automatic vending machine according to claim 1, wherein said lamps are arranged equidistantly along a curved line.

7. An automatic vending machine according to claim 1, wherein said repetition period is made longer progressively so as to decrease progressively the moving speed of the light spot.

8. An apparatus according to claim 1 further comprising article selection means for selecting any one of a plurality of kinds of articles, whereby said at least one extra article is the same as that selected by the user.

9. An apparatus according to claim 1 further comprising article selection means for selecting any one of a plurality of kinds of articles, whereby said at least one extra article is one of the articles selected by the article selection means.

10. An automatic vending machine according to claim 1, wherein said lottery circuit comprises a gate connected between the clock pulse generator and the lamp driving circuit, a timing circuit for receiving the signal generated in response to the vending operation of the machine to make said gate conductive for the given time period, a ring counter for receiving said clock pulses, a coincidence circuit for detecting a coincidence between a count of said ring counter and that of the ring counter in the lamp driving circuit to produce a coincidence signal as the winning signal and a ring counter control circuit for receiving said winning signal to control the lamp driving circuit in such a manner that the light spot is stopped at the predetermined lamp having the lucky number applied thereto.

11. An automatic vending machine according to claim 1, wherein said lottery circuit comprises a gate connected between the clock pulse generator and the lamp driving circuit, a timing circuit for receiving the signal generated in response to the vending operation of the machine to make said gate conductive for the given time period, a rotary switch having a rotary arm which is driven by an output signal from said timing circuit and a plurality of contacts, an AND gate having one input connected to the output of the timing circuit through a delay circuit and the other input connected to at least one of the contacts of the rotary switch to produce an output signal as the winning signal, and a ring counter control circuit for receiving the winning signal to control the ring counter in the lamp driving circuit in such a manner that the light spot is stopped at the predetermined lamp having the lucky number applied thereto.

12. An automatic vending machine according to claim 1, wherein said lottery circuit comprises a counter for counting the number of the vending operations of the machine, a preset circuit for presetting a given count, a coincidence circuit for detecting a coincidence between the count of said counter and the preset count to produce a coincidence signal as the winning signal, and a control circuit for receiving said winning signal to control the lamp driving circuit in such a manner that the light spot is stopped at predetermined lamp having the lucky number applied thereto.

13. An automatic vending machine according to claim 1, wherein said lottery circuit comprises a second clock pulse generator, a ring counter for receiving the clock pulses from said second clock pulse generator to produce an output pulse every time it counts a maximum count value, a preset circuit for presetting the maximum count value of the ring counter, a timing circuit for receiving the signal generated in response to the vending operation of the machine and the clock pulses from the second clock pulse generator to produce an output pulse in synchronism with the clock pulse, a coincidence circuit for detecting a coincidence between said output pulses from the ring counter and the timing circuit to produce a coincidence signal as the winning signal, and a control circuit for receiving the winning signal to control said lamp driving circuit in such a manner that the light spot is stopped at the predetermined lamp having the lucky number applied thereto.

14. An automatic vending machine according to claim 1, wherein said lottery circuit comprises a random number generator for producing a random number in response to the signal generated by the vending operation of the machine, an address generator for receiving the random number to produce an address corresponding to the received random number, a random accessory memory having a given number of address positions among which at least one predetermined address position has been preset as a winning position, a read out circuit for reading out the address position corresponding to the related address, a decision circuit for detecting whether the read out address position has been preset as the winning position or not, and an address change circuit for changing the related address number by a predetermined number when the related address position has been already read out, whereby when the winning signal is supplied from the decision circuit to the lamp driving circuit, the light spot is stopped at the predetermined lamp having the lucky number applied thereto.

15. An automatic vending machine according to claim 14, wherein said lottery circuit is constructed by a microcomputer.

* * * * *